US008342865B2

(12) United States Patent
Scheibelmasser et al.

(10) Patent No.: US 8,342,865 B2
(45) Date of Patent: Jan. 1, 2013

(54) DEVICE FOR CONNECTING ELECTRICAL LINES FOR BORING AND PRODUCTION INSTALLATIONS

(75) Inventors: Anton Scheibelmasser, Graz (AT); Abdelrhani Lamik, Leoben (AT); Bouchra Lamik-Thonhauser, St. Peter-Freienstein (AT)

(73) Assignee: Advanced Drilling Solutions GmbH, Leoben (AU)

( * ) Notice: Subject to any disclaimer, the term of this patent is extended or adjusted under 35 U.S.C. 154(b) by 0 days.

(21) Appl. No.: 13/127,155

(22) PCT Filed: Jun. 8, 2010

(86) PCT No.: PCT/AT2010/000202

§ 371 (c)(1), (2), (4) Date: May 2, 2011

(87) PCT Pub. No.: WO2010/141969

PCT Pub. Date: Dec. 16, 2010

(65) Prior Publication Data

US 2011/0217861 A1 Sep. 8, 2011

(30) Foreign Application Priority Data

Jun. 8, 2009 (AT) ..... A 881/2009

(51) Int. Cl.
*H01R 4/60* (2006.01)

(52) U.S. Cl. ..... 439/191; 430/191

(58) Field of Classification Search ..... 439/190–195; 166/65.1

See application file for complete search history.

(56) References Cited

U.S. PATENT DOCUMENTS

| | | | | | |
|---|---|---|---|---|---|
| 2,178,931 | A | * | 11/1939 | Crites et al. | 439/191 |
| 3,518,609 | A | | 6/1970 | Fontenot | |
| 3,879,097 | A | * | 4/1975 | Oertle | 340/855.1 |
| 3,989,330 | A | * | 11/1976 | Cullen et al. | 439/194 |
| 4,012,092 | A | * | 3/1977 | Godbey | 439/191 |
| 4,079,968 | A | * | 3/1978 | Wilkins, Jr. | 285/47 |
| 4,095,865 | A | * | 6/1978 | Denison et al. | 439/191 |
| 4,121,193 | A | * | 10/1978 | Denison | 340/855.1 |
| 4,176,894 | A | * | 12/1979 | Godbey | 439/194 |
| 4,220,381 | A | * | 9/1980 | van der Graaf | 340/853.7 |
| 4,304,456 | A | | 12/1981 | Takaki et al. | |
| 4,416,495 | A | * | 11/1983 | Regan | 439/192 |

(Continued)

FOREIGN PATENT DOCUMENTS

DE 91 16 310 U1 7/1992

(Continued)

OTHER PUBLICATIONS

International Search Report, dated Feb. 28, 2011, from corresponding PCT application.

*Primary Examiner* — Ross Gushi
(74) *Attorney, Agent, or Firm* — Young & Thompson

(57) ABSTRACT

A device for connecting two electrical lines to essentially tubular connecting elements (1, 2) of drill pipes (32), which elements can be screwed to one another, characterized in that on one connecting element (1), a first electrical contact element (10) is located to be able to move in the direction of rotation of the connecting element (1), and that on the other connecting element (2), a second electrical contact element (23) is located in a fixed manner.

20 Claims, 8 Drawing Sheets

U.S. PATENT DOCUMENTS 4,445,734 A * 5/1984 Cunningham ..... 439/194
4,496,203 A * 1/1985 Meadows ..... 439/194
4,537,457 A * 8/1985 Davis et al. ..... 439/190
4,557,538 A * 12/1985 Chevalier ..... 439/194
4,591,226 A * 5/1986 Hargett et al. ..... 439/192
4,660,910 A * 4/1987 Sharp et al. ..... 439/194
4,690,212 A * 9/1987 Termohlen ..... 166/65.1
4,767,349 A * 8/1988 Pottier et al. ..... 439/191
4,799,544 A * 1/1989 Curlett ..... 166/65.1
4,806,115 A * 2/1989 Chevalier et al. ..... 439/194
4,857,006 A 8/1989 Linyeav et al.
4,909,741 A * 3/1990 Schasteen et al. ..... 439/13
4,921,438 A * 5/1990 Godfrey et al. ..... 439/190
4,953,636 A * 9/1990 Mohn ..... 166/65.1
5,052,941 A * 10/1991 Hernandez-Marti et al. . 439/194
5,131,464 A * 7/1992 Lenhart et al. ..... 166/65.1
5,141,051 A * 8/1992 Lenhart ..... 166/65.1
5,219,298 A * 6/1993 Morin et al. ..... 439/192
5,348,492 A * 9/1994 Sonnet ..... 439/194
6,123,561 A * 9/2000 Turner et al. ..... 439/194
6,223,826 B1 * 5/2001 Chau et al. ..... 166/380
6,367,564 B1 * 4/2002 Mills et al. ..... 175/40
6,392,317 B1 * 5/2002 Hall et al. ..... 307/90
6,402,524 B2 * 6/2002 Wurm et al. ..... 439/10
6,446,728 B2 * 9/2002 Chau et al. ..... 166/380
6,641,434 B2 * 11/2003 Boyle et al. ..... 439/577
6,655,464 B2 * 12/2003 Chau et al. ..... 166/380
6,670,880 B1 * 12/2003 Hall et al. ..... 336/132
6,717,501 B2 * 4/2004 Hall et al. ..... 336/132
6,776,636 B1 * 8/2004 Cameron et al. ..... 439/191
6,780,037 B1 8/2004 Parmeter et al.
6,821,147 B1 * 11/2004 Hall et al. ..... 439/581
6,830,467 B2 * 12/2004 Hall et al. ..... 439/194
6,845,822 B2 * 1/2005 Chau ..... 166/380
6,913,093 B2 * 7/2005 Hall et al. ..... 175/57
6,929,493 B2 * 8/2005 Hall et al. ..... 439/191
6,945,802 B2 * 9/2005 Hall et al. ..... 439/194
6,974,341 B2 * 12/2005 Jennings ..... 439/191
7,037,126 B2 * 5/2006 Tsutsumi et al. ..... 439/191
7,053,788 B2 * 5/2006 Hall et al. ..... 340/854.4
7,064,676 B2 * 6/2006 Hall et al. ..... 340/853.1
7,074,064 B2 * 7/2006 Wallace ..... 439/190
7,093,654 B2 * 8/2006 Hall et al. ..... 166/242.6
7,098,767 B2 * 8/2006 Hall et al. ..... 336/234
7,114,970 B2 * 10/2006 Head ..... 439/191
7,150,329 B2 * 12/2006 Chau ..... 166/380
7,156,676 B2 * 1/2007 Reynolds, Jr. ..... 439/194
7,190,280 B2 * 3/2007 Hall et al. ..... 340/855.1
7,201,240 B2 * 4/2007 Hall et al. ..... 175/320
7,291,028 B2 * 11/2007 Hall et al. ..... 439/194
7,373,970 B1 * 5/2008 Wintill et al. ..... 166/65.1
7,390,032 B2 * 6/2008 Hughes ..... 285/330
7,404,725 B2 * 7/2008 Hall et al. ..... 439/194
7,462,051 B2 * 12/2008 Hall et al. ..... 439/194
7,605,715 B2 * 10/2009 Clark et al. ..... 340/854.4
7,649,475 B2 * 1/2010 Hall et al. ..... 340/854.9
7,748,444 B2 * 7/2010 Scott et al. ..... 166/65.1
7,806,191 B2 * 10/2010 Braden et al. ..... 166/380
7,866,404 B2 * 1/2011 Rodney ..... 166/380
7,934,570 B2 * 5/2011 Hall et al. ..... 175/320
8,033,329 B2 * 10/2011 Montgomery et al. ..... 166/65.1
8,120,508 B2 * 2/2012 Madhavan et al. ..... 340/853.1
8,130,118 B2 * 3/2012 Hall et al. ..... 340/853.7
8,157,002 B2 * 4/2012 Clarkson et al. ..... 166/65.1
2001/0012703 A1 * 8/2001 Wurm et al. ..... 439/32
2002/0014336 A1 * 2/2002 Jones ..... 166/341
2002/0112852 A1 * 8/2002 Floerke et al. ..... 166/65.1
2002/0135179 A1 * 9/2002 Boyle et al. ..... 285/21.1
2002/0193004 A1 * 12/2002 Boyle et al. ..... 439/577
2003/0075319 A1 * 4/2003 Chau ..... 166/65.1
2003/0211768 A1 * 11/2003 Cameron et al. ..... 439/191
2004/0221995 A1 * 11/2004 Hall et al. ..... 166/380
2004/0242044 A1 * 12/2004 Head ..... 439/190
2005/0001738 A1 * 1/2005 Hall et al. ..... 340/854.8
2005/0022999 A1 * 2/2005 Hughes ..... 166/380
2005/0046586 A1 * 3/2005 Hall et al. ..... 340/853.4
2005/0046590 A1 * 3/2005 Hall et al. ..... 340/854.8
2005/0067159 A1 * 3/2005 Hall et al. ..... 166/65.1
2005/0070143 A1 * 3/2005 Eriksson et al. ..... 439/191
2005/0070144 A1 * 3/2005 Hall et al. ..... 439/191
2005/0074998 A1 * 4/2005 Hall et al. ..... 439/191
2005/0092499 A1 * 5/2005 Hall et al. ..... 166/380
2005/0098356 A1 * 5/2005 Chau ..... 175/321
2005/0118848 A1 * 6/2005 Hall et al. ..... 439/194
2005/0150653 A1 * 7/2005 Hall et al. ..... 166/178
2005/0284662 A1 * 12/2005 Hall et al. ..... 175/40
2006/0124291 A1 * 6/2006 Chau ..... 166/65.1
2006/0124354 A1 6/2006 Witte
2006/0225926 A1 * 10/2006 Madhavan et al. ..... 175/320
2006/0260797 A1 * 11/2006 Hall et al. ..... 166/65.1
2007/0167051 A1 * 7/2007 Reynolds, Jr. ..... 439/194
2008/0003856 A1 * 1/2008 Hall et al. ..... 439/191
2010/0170671 A1 * 7/2010 Sihler ..... 166/65.1
2011/0215569 A1 * 9/2011 Lamik et al. ..... 285/333
2012/0012301 A1 * 1/2012 Hughes et al. ..... 166/65.1
2012/0111555 A1 * 5/2012 Leveau et al. ..... 166/65.1

FOREIGN PATENT DOCUMENTS

EP 0 860 902 A2 8/1998

* cited by examiner

DEVICE FOR CONNECTING ELECTRICAL LINES FOR BORING AND PRODUCTION INSTALLATIONS

The invention relates to a device for connecting electrical lines to essentially tubular connecting elements of drill pipes, which elements can be screwed to one another.

BACKGROUND OF THE INVENTION

One important element in modern petroleum, natural gas and geothermal drilling is data acquisition during the drilling process; however, the same also applies to the construction of the drill hole and the subsequent petroleum, natural gas and hot water production. Only by acquiring the respective relevant measurement quantities can drilling be pursued safely, efficiently and economically. One problem arises in real time data transmission of measurement data to the surface of the drilling rig. Data are to be transmitted at a high data rate (for example, 200 kBaud) from several kilometers deep.

Currently, simple steel pipes without cabling are used to some extent on drilling rigs. The pipes are coupled at regular intervals (for example, 9 meters). In this way, a drilling column that is several kilometers long is formed on whose end the drilling bit is located. Within the pipes is the flush fluid (rinsing fluid) that performs many kinds of functions during the drilling process. One of these functions in the prior art is the transmission of data by means of pressure pulses. Since this communication is very slow (for example, 10 baud), methods have been increasingly sought that use other transmission mechanisms (sonar, currents via the ground, etc.). Approaches that are associated with cabling of the drilling column have proven most efficient (current, light, etc.). As soon as the drilling column is connected by means of electrical cables or conductive layers, high-speed data transmission is possible.

Here, fundamentally two methods are possible. Some prototypes work with galvanic connections between the individual pipes of the column. Systems that are to some extent commercially available use a magnetic coupling between the pipes. The magnetic coupling that is currently in use allows only data transmission.

The intention to cable a drill string encounters several problems at the same time.

Steel pipes must be produced or retrofitted with pressure-proof, mud-resistant and heat-resistant cables without the bearing strength of the drill string being influenced and without personnel being hindered in screwing the pipes together.

In order to enable data transmission in the drill string, the problem of the electrical connection between the pipes must be solved. The electrical connection must be produced reliably, easily and durably in the mechanical connection of the pipes (rotary motion). The greatest challenge in making an electrical connection that can transmit current and/or data is the screwing motion during the screw connection process of the individual drilling column (pipes). Moreover, the drilling process constitutes a harsh environment, due to extensive fouling and liquids of all type. This challenge is to be overcome in order to develop a successful system that is ready for use.

SUMMARY OF THE INVENTION

This object is achieved in a device of the initially named type in that on one connecting element, a first electrical contact element is located in a fixed manner, and that on the other connecting element, a second electrical contact element is located with the capacity to move in the direction of rotation of the connecting element.

The construction solves the problem that in the screw connection of the two connecting elements, two components of motion occur, specifically one in the peripheral direction and one in the axial direction of the connecting elements. Due to the circumstance that one of the two contact elements is movable in the peripheral direction, in the production of the electrical or galvanic connections between the two contact elements, it can turn concomitantly with the other connecting element so that the two connecting elements need be connected to one another only by way of the axial component of motion.

In one preferred embodiment of the invention, the movable contact element is located on a ring that is pivoted on the connecting element, the ring being preferably an outer ring of a slip ring. Slip rings in electrical engineering are proven and durable components that can also be used in this case to compensate the turning components of motion during the connection of the two connecting elements.

This approach is suitable for data and energy transmission in the drilling column based on cabled pipes (for example, steel or CFK or GFK pipes) whose cabling is galvanically connected on the pipe ends.

The cabling can take place with a two-wire, heat-resistant voltage supply cable that is installed in a protective pipe (chemical resistance). On the surface, both electrical energy and also data can be fed into this cable. In the case of the turning drill string, this is done with slip rings. In the pipe, this cable is routed to a connecting element that establishes a well-conductive connection to the next pipe.

Preferably, DC voltage can be used in the network voltage domain for energy feed. Matching to all possible supply networks takes place one time centrally before feed.

In addition to data communications, the problem of energy supply of the data transmission elements can also occur (modem, repeater, transceiver, etc.). Since the drilling column can be several kilometers long (for example, 20 km), the problem of data transmission over long lines must be solved. High-speed data transmissions (for example, field bus systems) can only be used for a few 100 meters without repeaters. The use of many repeaters, however, presupposes a sufficient voltage supply. This is a problem, however, for great distances and many repeaters due to voltage drops. The installation of batteries in the repeaters does solve the problem of energy transmission, but also leads to unreliable systems that can be poorly maintained (battery changing, battery failure). The installation of repeaters in the drilling column due to lack of space is also quite problematical.

To solve this problem, it is suggested in the invention that a carrier frequency system be connected to the electrical lines.

A narrowband OFDM (orthogonal frequency division multiplex, multicarrier) method can be used for the feed of data using a carrier frequency system. This method is, however, also known as "power line communication (PLC)." Modems that use this method are currently used in electric power networks for remote maintenance or remote meter reading (distributed line communication, DLC). Thus, information can be exchanged over several kilometers without repeaters with data rates of a few hundred kilobauds over conventional power supply lines without additional cabling.

With this modem, the data are modulated onto the voltage supply in several carrier frequencies, fed into the drill string with slip rings, and transmitted in the turning drill string via the connecting elements on the pipe ends to the receiving site (consumers, electronic measurement system) in the drill hole.

Several of these modems can transmit and receive not only energy, but also data through the connected power supply.

Advantages of this problem solution lie among others in that by using the PLC modulation, separate cabling for data communication is not necessary. This approach is therefore economical. For the desired drill string length (roughly 20 km), a repeater is unnecessary; this solves space and energy problems. Since separate data cabling is unnecessary, additional galvanic contacts on the pipe connections are omitted. Since repeaters are unnecessary, the necessary amount of energy is reduced such that in an economical selection of the necessary conductor cross-section (for example, 4-6 $mm^2$), a network voltage (for example, 400 V) is sufficient to bring the required energy (for example, 200 W) to a consumer roughly 20 km away.

The presence of a permanent power supply enables cooling of electronic systems in the drill string and thus enables a greater drilling depth (temperature coefficient in the bore roughly 3.3° C./100 m) and longer residence time. Energy and data supply enable a series of new applications. Limitation of the supply voltage to, for example, 400 V enables the selection of a standard cable (for example, 240/400 V) and reduces the required insulation distances in the mechanical design of the system components compared to high-voltage systems.

Other preferred embodiments of the invention are the subject matter of the other dependent claims.

Other features and advantages of the invention will become apparent from the following description of one preferred embodiment of the invention with reference to the drawings.

BRIEF DESCRIPTION OF THE DRAWINGS

Here.

DETAILED DESCRIPTION OF THE PREFERRED EMBODIMENTS

Figure 1:
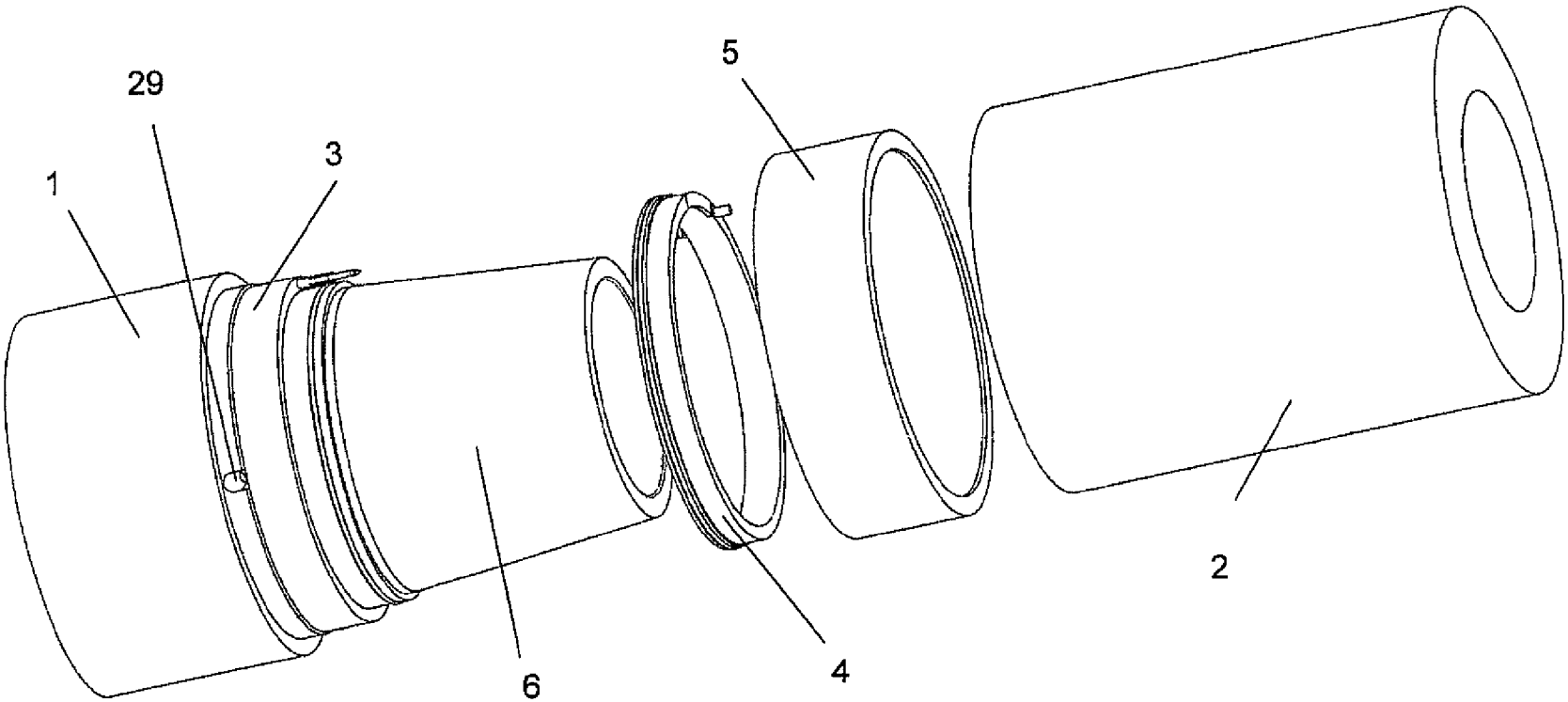
FIG. 1 shows one embodiment of a device according to the invention in an exploded view.
Figure 2:
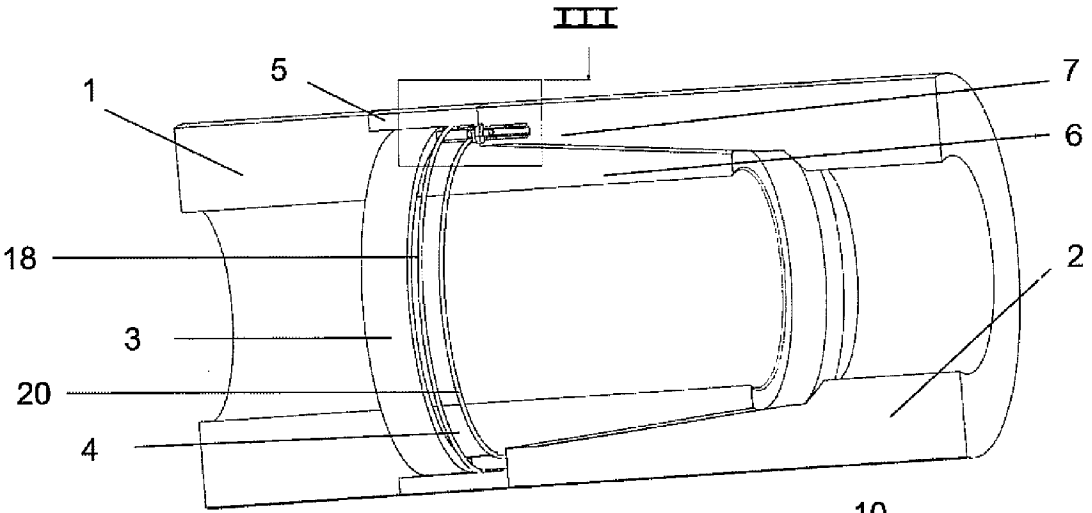
FIG. 2 shows the device in the assembled state in a cross-section.

FIG. 1 shows one embodiment of a device according to the invention that is used for connecting drill pipes 32, for example drill strings in drilling rigs. The device according to the invention has a first connecting element 1 that is subsequently called a "pin" and a second connecting element 2 that is subsequently called a "box". The pin 1 and the box 2 are connected in a manner that is not shown to the drill pipes 32 that can be produced, for example, from steel, CFK or GFK. The inside diameter of the pin 1 and of the box 2 corresponds essentially to the inside diameter of the drill pipe 32; conversely, the outside diameter of the pin 1 and of the box 2 is larger than the outside diameter of the drill pipe 32.

A slip ring 3 and a catch ring 4 are pivotally accommodated on the pin 1 and are surrounded in the assembled state by an outer ring 5. The diameter of the outer ring 5 is slightly smaller than the diameter of the pin 1 and the box 2 and is produced from a wear-resistant material so that it can be used as a wearing part that can be easily replaced and that protects the pin 1 and the box 2 against undue wear. On its end 6 facing the box 2, the pin 1 has a conically tapering outside diameter with an external thread. The box 2 conversely on its end 7 facing the pin 1 has a conically widening inside diameter with the same angle of taper and an internal thread. The pin 1 and the box 2 can be screwed to one another in this way by a few turns over a relatively great length.

Figure 8:
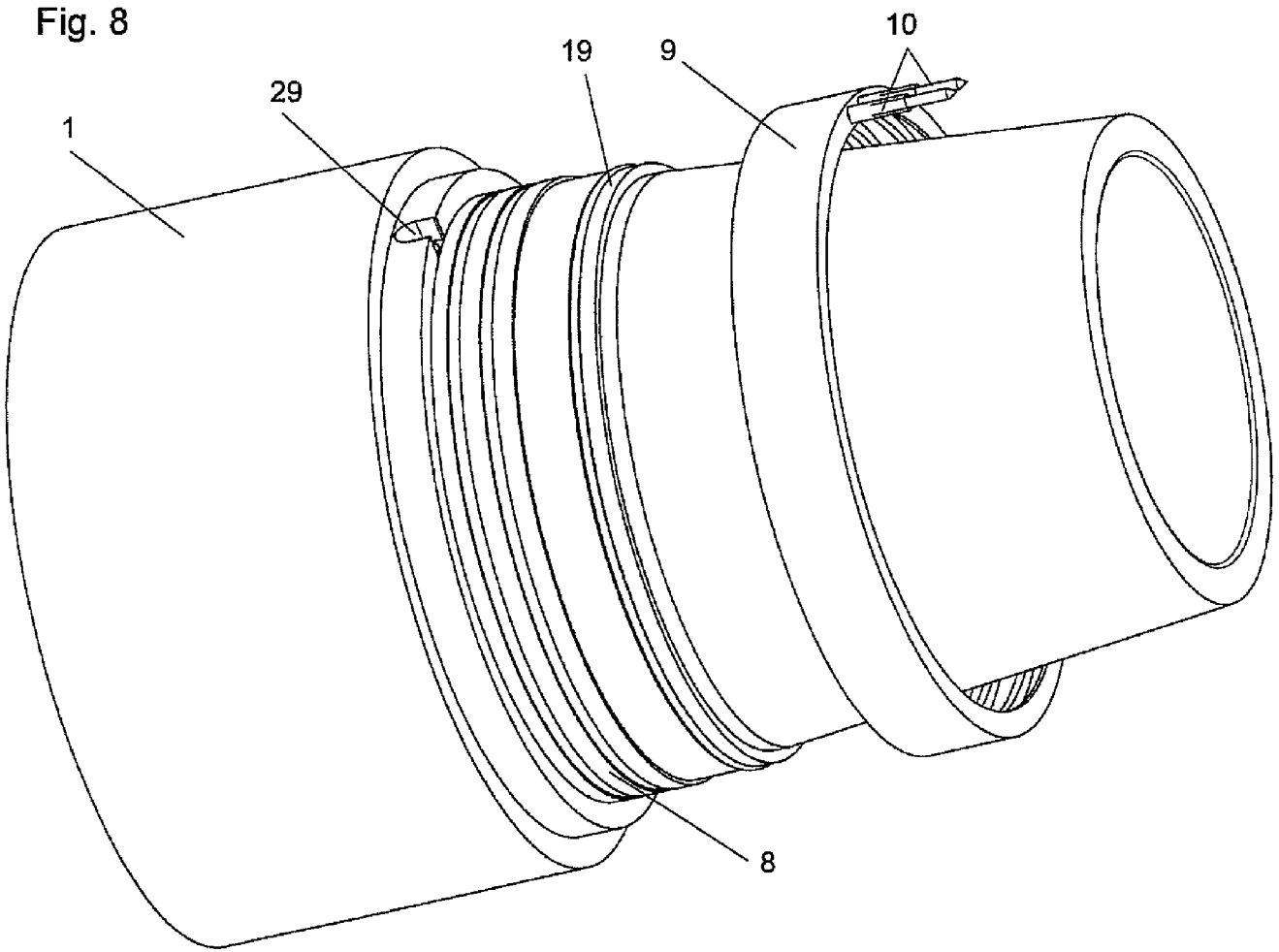
FIG. 8 shows a part of the device according to the invention in an exploded view.

The slip ring 3, as is shown in detail in FIG. 8, consists of an inner ring 8 that is located on the pin 1 and an outer ring 9 that can be turned in the peripheral direction relative to the inner ring 8. The outer ring 9 is fixed relative to the inner ring 8 in the axial direction. The slip ring 3—aside from the details explained below—is otherwise built as known inherently from the prior art.

In the illustrated embodiment on the outer ring 9, there are two electrical contact elements in the form of contact pins 10 that are electrically connected to brushes of the outer ring 9. There can be an equal number of contact pins 10 and sliding contacts on the slip ring 3. It is also possible, however, in order to form an especially reliable electrical connection, also, for example, to provide two contact pins 10 per sliding contact. Alternatively, it is also possible to provide more sliding contacts than contact pins 10 on a standard basis in order to make available the possibility of other electrical connections between the pin 1 and the box 2, if necessary.

Figure 5:
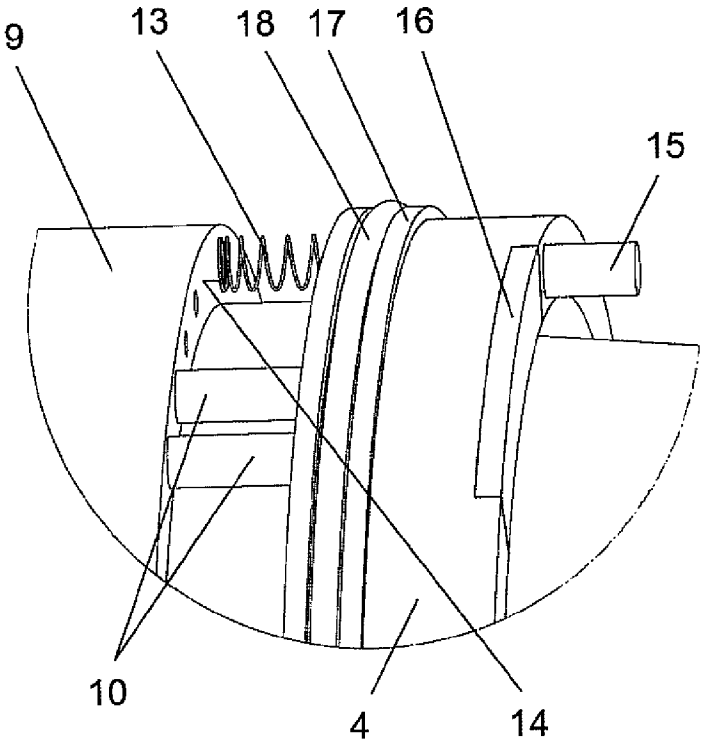
FIG. 5 shows a detail from FIG. 4 on an enlarged scale.
Figure 4:
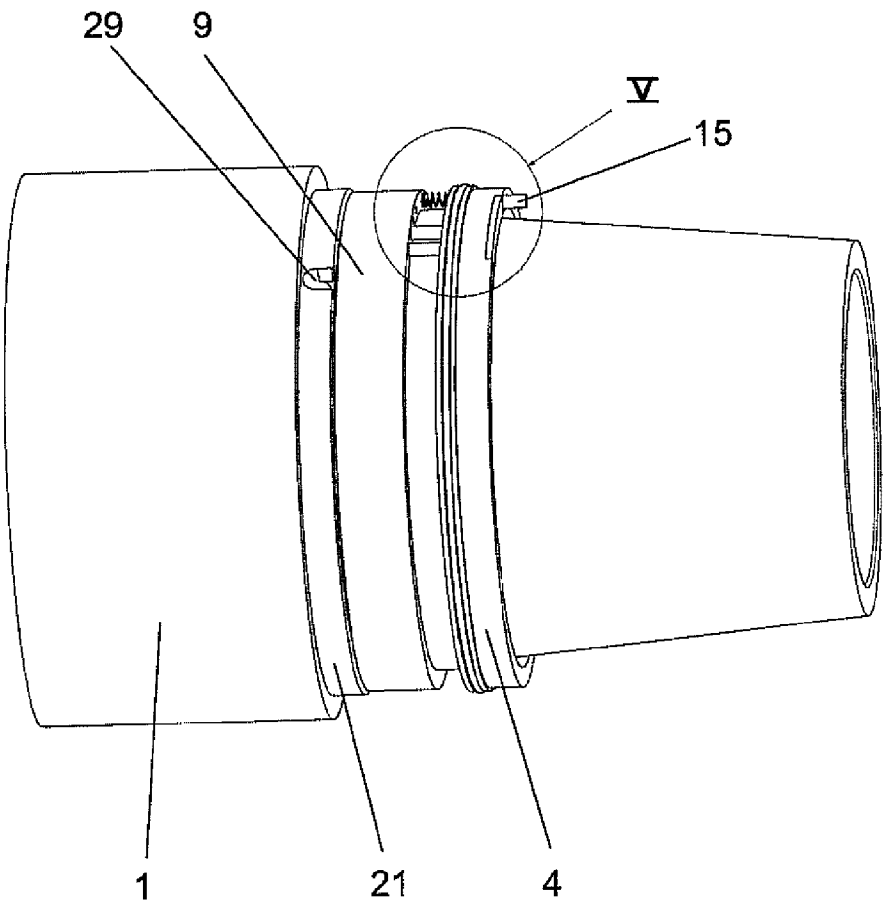
FIG. 4 shows a part of the device according to the invention.
Figure 6:
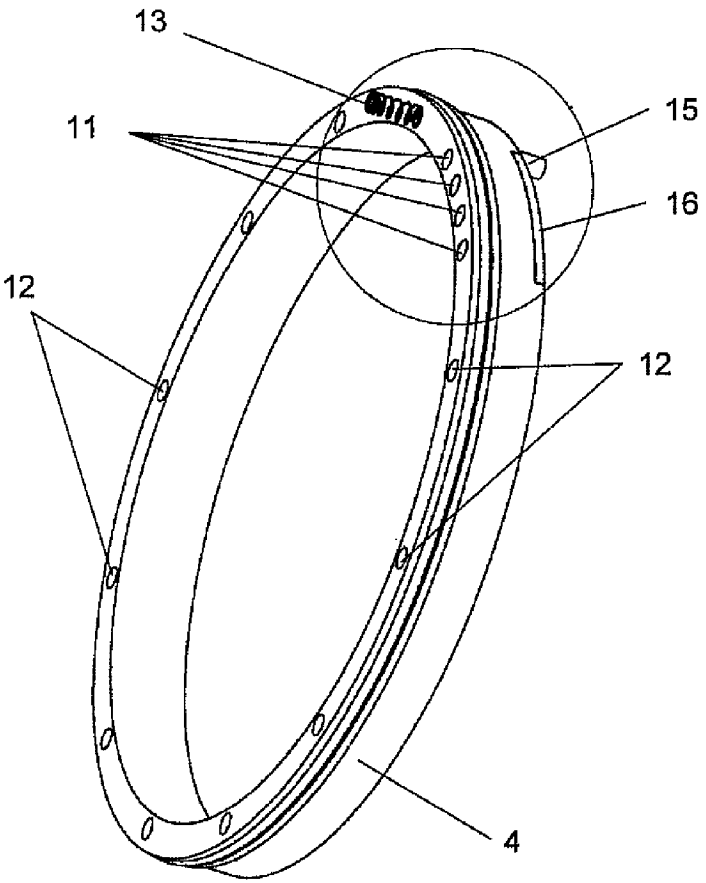
FIG. 6 shows another part of the device according to the invention.

FIGS. 5 and 6 show the catch ring 4 in greater detail. In the illustrated embodiment, it has four through openings 11 for contact pins 10. Moreover, on the side facing the slip ring 3, it has slots 12 (in the illustrated embodiment, eleven slots 12) for compression springs 13 that are supported on the face surface 14 of the outer ring 9. The compression springs 13 in the compressed state are held completely in the slots 12. On the side opposite the slots 12 or compression springs 13, on the catch ring 4, a catch pin 15 is supported to be able to move in the axial direction against a compression spring that is not shown. On the same side on which the catch pin 15 is located, the through openings 11 are closed by a seal 16 that can still be penetrated by the contact pins 10 and after pulling back the contact pins 10 closes the through openings 11 again.

On the outer periphery of the catch ring 4 on the side facing the slip ring 3 on one bead 17, there is a gasket 18, for example an O ring. The outer ring 5 is screwed to the pin 1 via a thread 21, and the catch ring 4 with its gasket 18 adjoins the inside of the outer ring 5, forming a seal. On the pin 1, there is, furthermore, another groove 19 in the region underneath the catch ring 4 in which a gasket 20, for example an O ring, is located, which, moreover, adjoins the inside of the catch ring 4, forming a seal. The thread 21 and the gaskets 18 and 20 can tightly seal the space in which the slip ring 3 is located.

Figure 3:
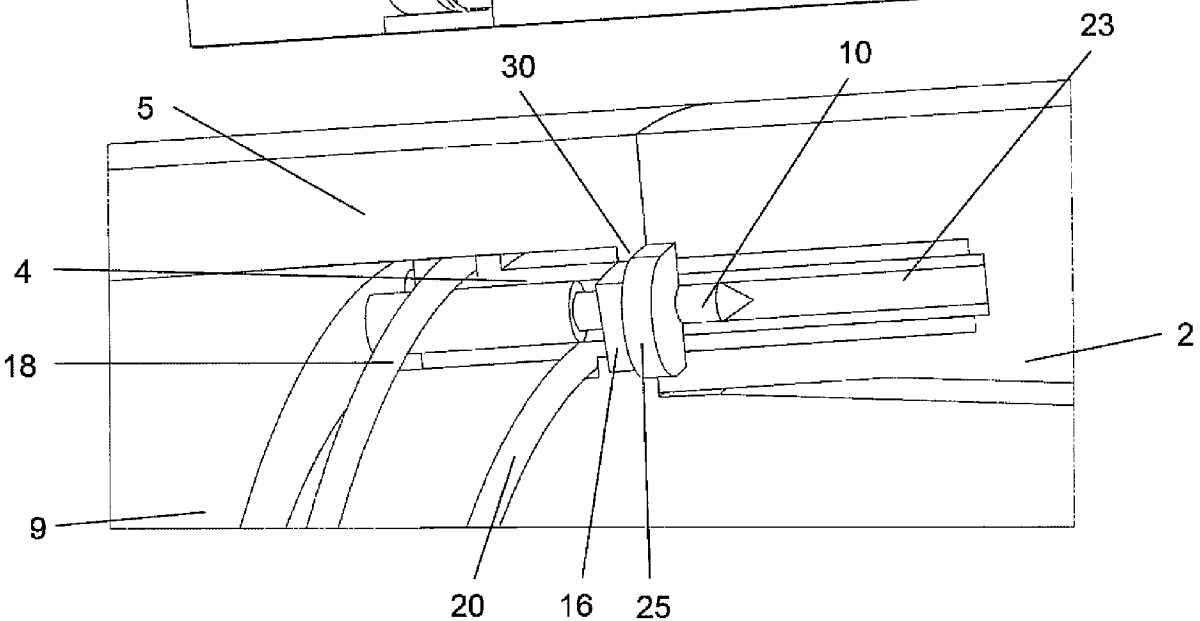
FIG. 3 shows a detail of the device from FIG. 2 on an enlarged scale.
Figure 7:
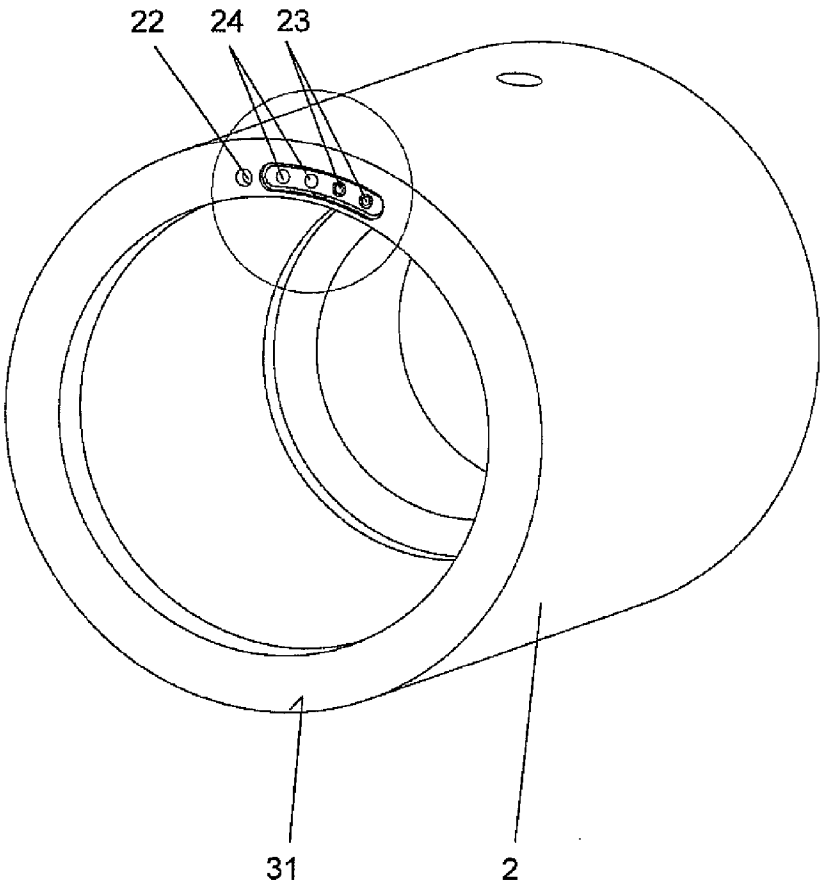
FIG. 7 shows a different part of the device according to the invention.

On the side facing the catch ring 4, the box 2, on the one hand, has a catch opening 22 for the catch pin 15, and, on the other hand, contact elements in the form of contact bushings 23. Since only two contact pins 10 are used in the embodiment shown in the drawings, there are also only two contact bushings 23. In addition to the two contact bushings 23, there are two other slots 24 that if necessary can be equipped with contact bushings 23. FIG. 3 shows that the contact bushings 23 and the slots 24 are likewise closed by a seal 25 that can likewise be penetrated by the contact pins 10, and after pulling back the contact pins 10 can close the contact bushings 23 again. The seal 25 is not shown in FIG. 7.

The seals 16 and 25 are seals that can be perforated and that can be produced, for example, from rubber and that can be provided with a perforation from the start that facilitates penetration and removal of the contact pins 10, and in any case it must be ensured that the seals 16 and 25 even without contact pins 10 are so tight that sparks or arcs cannot be ignited or jump when the contact pins 10 or contact bushings 23 are under voltage in order to minimize a possible explosion hazard. Moreover, the seal must prevent the danger of fouling and penetration of the most varied liquids under the harsh conditions of a drilling process.

Figure 9:
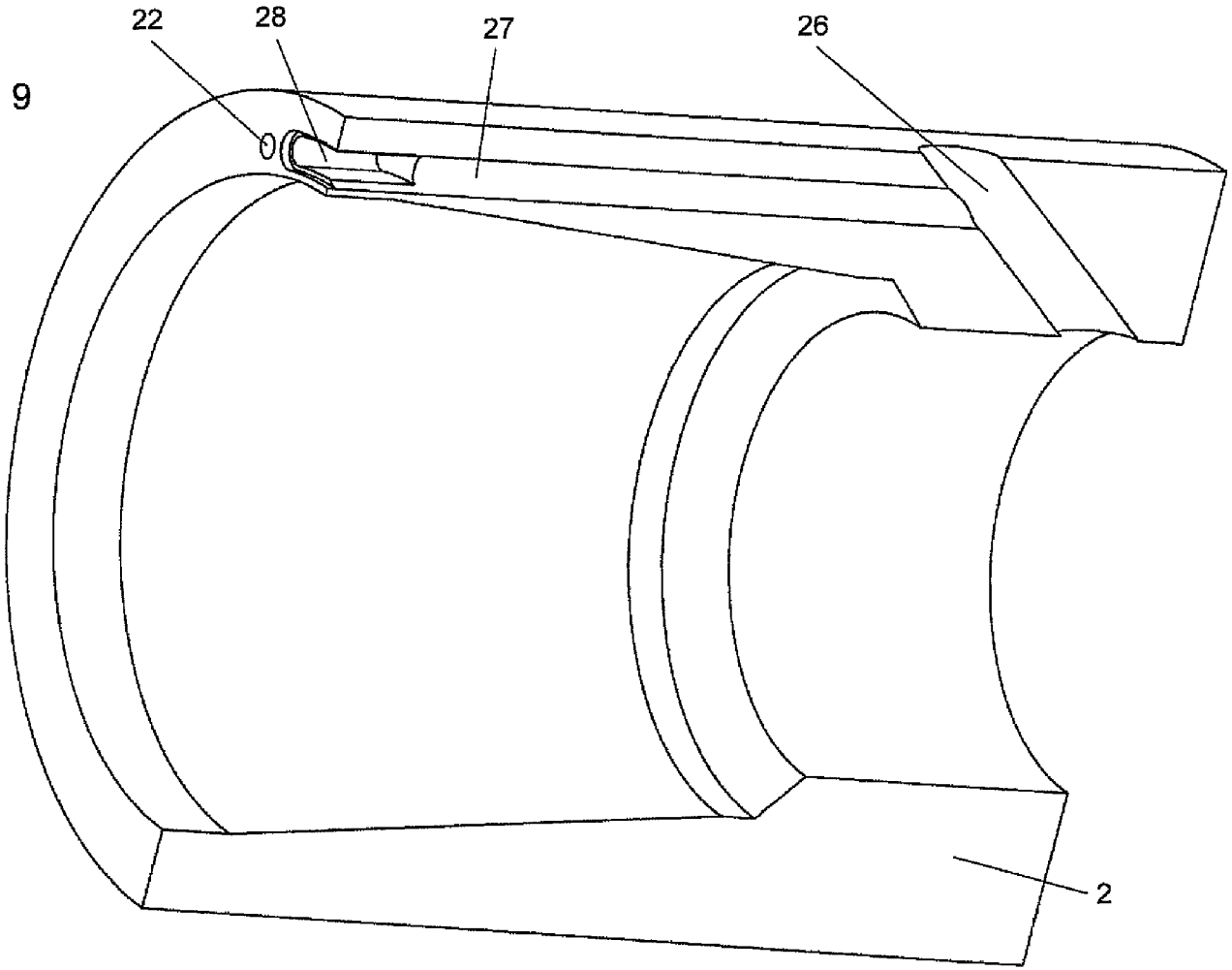
FIG. 9 shows a cross-section through one part of the device according to the invention.
Figure 10:
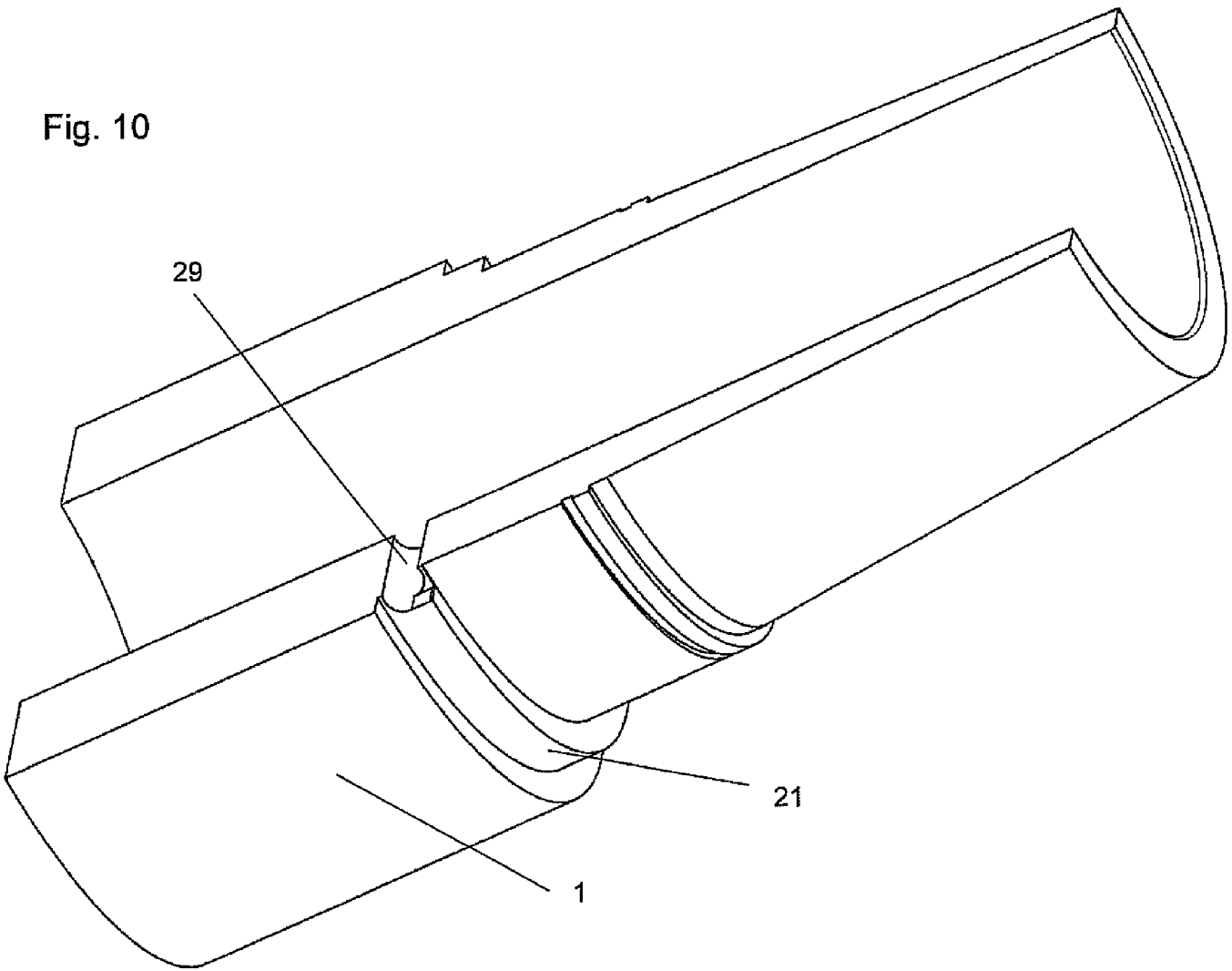
FIG. 10 shows a cross-section through another part of the device according to the invention.

FIG. 9 shows a cross-section of the box 2 in which a bore 26 that leads first obliquely from the inside of the box 2 to the outside and furthermore a bore 27 that branches off from the latter bore and that is aligned in the axial direction can be seen, which lead to slots 28 in which the contact bushings 23 are held. The contact bushings 23 can be connected to a line that is located in the interior of the drill pipes 32 through these bores 26 and 27 and optionally an elbow joint that is not shown. FIG. 10 shows a cross-section through the pin 1, in which a bore 29 can be seen that leads from the interior of the pin 1 to the slip ring that is not shown in this drawing. In this way, a line that is located in the interior of a drill pipe 32 can optionally be connected to the sliding contacts of the inner ring 8 optionally via an elbow joint that is not shown and that adjoins the bore 28 within the pin 1.

Generally, there will be one pin 1 on one drill pipe 32 on one end and a box 2 on the other end, and the respective contact elements (contact pins 10 and contact bushings 23) can be connected to one another via the electrical line that runs within the drill pipe 32. By screwing together the drill pipes 32 via one pin 1 and one box 2 at a time, a continuous electrical line can thus be produced that runs along the entire drill string.

The pin 1 and the box 2 are screwed together according to the invention as follows. In the separated state of the pin 1 and the box 2, the catch ring 4 is pressed by the compression springs 13 so far away from the outer ring 9 that its bead 17 or its gasket 18 adjoins a projection 30 of the outer ring 5 that projects to the inside. Since the outer ring 9 cannot be moved axially, the tips of the contact pins 10 are pulled so far to the inside in the catch ring 4 that they lie behind the seal 16 and do not penetrate it. If the box 2 is inserted over the conical end 6 of the pin 1 and twisted in doing so in order to screw the box 2 onto the pin 1, the box 2 with its face surface 31 first comes into contact with the catch pin 15 that is pressed against the force of its compression spring to the rear into the catch ring 4 and locks into the catch hole 22 at the latest after one complete revolution of the box 2.

From this instant on, the catch ring 4 also with the box 2 and the outer ring 9 over the contact pins 10 are turned at the same time. As soon as the thread begins to engage between the pin 1 and the box 2, the catch ring 4 is pressed farther and farther against the outer ring 9 until it fully adjoins it. During this motion, the pointed catch pins 10 first begin to penetrate the seal 16 and subsequently the seal 25 until they penetrate into the contact bushings 23 and establish an electrical connection. Since the catch ring 4 and the box 2 are aligned exactly to one another in the peripheral direction by the catch pin 15, exact entry of the contact pins 10 into the contact bushings 23 is also ensured.

When the connection between the pin 1 and the box 2 is broken again, as the pin 1 and the box 2 are screwed apart, the catch ring 4 is pressed by the compression springs 13 away from the outer ring 9 so that the contact pins 10 are pulled out of the contact bushings 23. The compressive force of the compression springs 13 must therefore be so great that both the friction of the contact pins 10 in the contact bushings 23 and the seals 16, 25 and also the friction of the gaskets 18, 20 can be reliably overcome. The length of the contact pins 10 and the spring path of the catch ring 4 are matched to one another such that the catch ring 4 only detaches from the face surface 30 of the box 2 when the contact pins 10 are pulled back so far that they no longer penetrate the seals 16, 25 so that reliable separation of the pin 1 and the box 2 is ensured.

The construction solves the problem that when the two connecting elements are screwed together, two components of motion occur, specifically one in the peripheral direction and one in the axial direction of the connecting elements. Due to the circumstance that one of the two contact elements is movable in the peripheral direction, in the production of the electrical or galvanic connections between the two contact elements, it can turn concomitantly with the other connecting element so that the two connecting elements need be connected to one another only via the axial component of motion.

Compensation of the relative motion of the pin 1 and of the box 2 for producing the electrical connection during the screw connection process can also take place differently. The resolution of the degrees of freedom of motion between the pin 1 and the box 2 is important in the screw connection in the peripheral direction and in the axial direction. By one means, the position of one contact element 10, for example the plug position in the pin 1, must be aligned with the position of the other contact element 23, for example the bushing position in the box 2, during the screw connection such that the electrical contact pins enter the electrical bushings. Preferably, however, this may not necessarily take place via spring-loaded or electrical or magnetically activated catch pins 15 that are placed on the pin 1 or on the box 2 and provide for positioning of the contact pins during the screw connection process in the peripheral direction.

Figure 11:
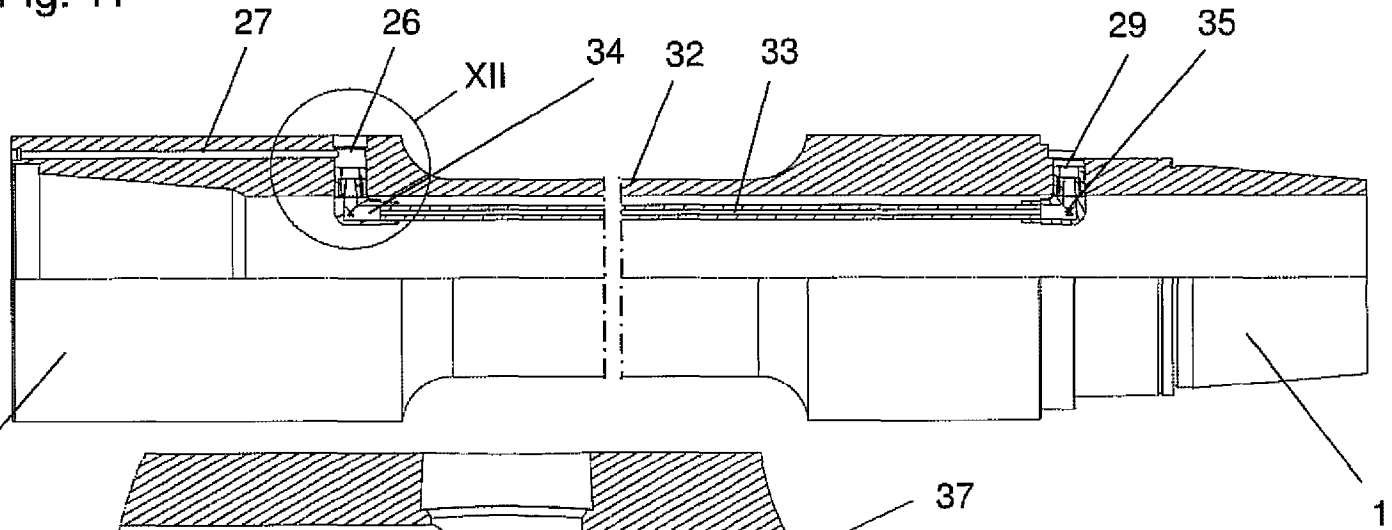
FIG. 11 shows a drill pipe with a box and a pin.
Figure 12:
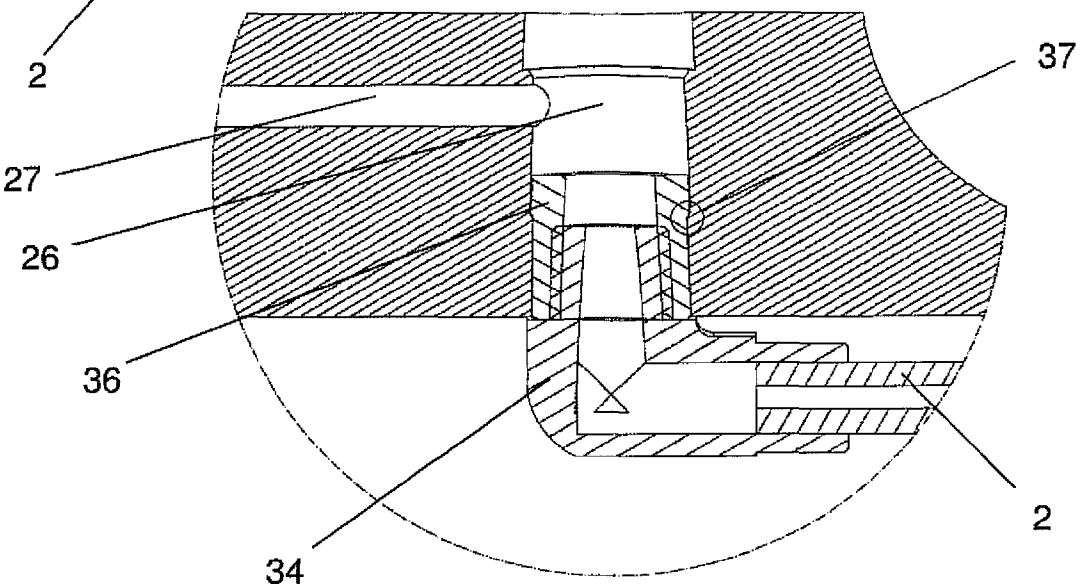
FIG. 12 shows a detail of the box on the drill pipe from FIG. 11.

FIG. 11 shows a drill pipe 32 on which on one end, there is a pin 1, and on the other end, there is a box 2. In the embodiment shown in FIG. 11, the drill pipe 32, the pin 1 and the box 2 are made integrally; this is one possible embodiment. Generally, the drill pipe 32, the pin 1 and the box 2 will, however, be separate components that are connected securely to one another.

In order to be able to install electrical lines within the drill pipe 32, in one embodiment of the invention within the drill pipe 32, there can be a cable duct 33 that is connected via elbow joints 34, to the pin 1 and the box 2 or the bores 26, 29 provided therein. Fittings 36 are inserted into the bores 26, 29 and seal the bores 26, 29 via conical shoulders 37 relative to the interior of the drill pipe 32. The elbow joints 34, 35 are screwed tightly into these fittings 36.

One or more electrical lines can be installed in this way from the pin 1 to the box 2 without coming into contact with the rinsing fluid located within the drill pipe 32.

The electrical connection can be produced, for example, by means of slip rings, and electrical transmission can take place between the outer ring and the inner ring by means of balls (such as a ball bearing) or by means of two metal rings that grind on one another (such as a slide bearing) or by means of electrical brushes.

It is also possible, however, for compensation of the rotary motion, to use a cable that is wound, for example, onto a cable drum that is provided with a spiral or coil spring. It would also be possible, however, to use a spiral or coil spring itself as an electrical conductor that compensates for the relative motion between the movable contact element and the pin 1 or the box 2.

The invention claimed is:

1. A device for connecting electrical lines to essentially tubular connecting elements (1, 2) of drill pipes (32), said connecting elements configured to be screwed to one another, characterized in that on one connecting element (1), a first electrical contact element (10) is located and movable in a direction of rotation of the one connecting element (1), and on an other connecting element (2), a second electrical contact element (23) is located in a fixed manner, wherein the movable first electrical contact element (10) is located on a ring (9) that is pivotable on the one connecting element (1).

2. The device according to claim 1, wherein the ring (9) is an outer ring of a slip ring (3).

3. The device according to claim 1, wherein in the one and the other connecting elements (1, 2), there are bores (26, 27, 29) through which the electrical lines lead.

4. The device according to claim 1, wherein a carrier frequency system is connected to the electrical lines.

5. The device according to claim 1, wherein the contact element (10) on the ring (9) is at least one contact pin that projects in an axial direction from the ring (9).

6. The device according to claim 1 , wherein the second electrical contact element (23) located in a fixed manner is a contact bushing that has a seal (25) on a side facing the movable first electrical contact element (10).

7. The device according to claim 6, wherein the seal (16, 25) is a seal that can be perforated.

8. The device according to claim 1, wherein the movable first electrical contact element (10) on the ring (9) is at least one contact pin that projects in an axial direction from the ring (9).

9. The device according to claim 8, wherein in the axial direction of the ring (9), there is a catch ring (4) that has a through opening (11) for the contact pin (10).

10. The device according to claim 9, wherein the catch ring (4) has a elastically supported catch pin (15) configured to engage a catch opening (22) on the other connecting element (2).

11. The device according to claim 10, wherein the catch ring (4) is movable relative to the slip ring (2) in a lengthwise direction of the contact pin (15).

12. The device according to claim 9, wherein the catch ring (4) is movable relative to the slip ring (2) in a lengthwise direction of the contact pin (15).

13. The device according to claim 12, wherein the catch ring (4) is movable from a first position in which a tip of the contact pin (10) lies within the catch ring (4) into a second position in which the tip of the contact pin (10) lies outside of the catch ring (4).

14. The device according to claim 13, wherein the catch ring (4) is pressed by at least one spring (13) from a first position in the lengthwise direction to a second position.

15. The device according to claim 12, wherein the catch ring (4) is pressed by at least one spring (13) from a first position in the lengthwise direction to a second position.

16. The device according to claim 9, wherein the through opening (11) has a seal (16) on a side facing away from the slip ring (2).

17. The device according to claim 16, wherein the seal (16, 25) is a seal that can be perforated.

18. The device according to claim 17, wherein the seal is a rubber seal.

19. The device according to claim 9, wherein the ring (9) and the catch ring (4) are surrounded by an outer ring (5).

20. The device according to claim 19, wherein the outer ring (5) has an outside diameter that is greater than an outside diameter of the one and the other connecting elements (1, 2).

* * * * *